US008400077B2

(12) United States Patent
Huang et al.

(10) Patent No.: US 8,400,077 B2
(45) Date of Patent: Mar. 19, 2013

(54) POWER SUPPLY CIRCUIT FOR POWERING LIGHT EMITTING DIODE

(75) Inventors: Chung-Tsai Huang, Taoyuan Hsien (TW); Po-Yi Lee, Taoyuan Hsien (TW); Shang-Jin Yan, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 348 days.

(21) Appl. No.: 12/817,738

(22) Filed: Jun. 17, 2010

(65) Prior Publication Data

US 2010/0320937 A1 Dec. 23, 2010

(30) Foreign Application Priority Data

Jun. 19, 2009 (TW) ..... 98120746 A

(51) Int. Cl.
*H05B 37/00* (2006.01)

(52) U.S. Cl. ..... 315/307; 315/193; 315/247

(58) Field of Classification Search ..... 315/291, 315/219, 224, 307, 308, 209 R, 185 R, 193, 315/247, 246
See application file for complete search history.

(56) References Cited

U.S. PATENT DOCUMENTS

| | | | | |
|---|---|---|---|---|
| 7,880,401 | B2 * | 2/2011 | Kitagawa et al. | 315/247 |
| 7,902,771 | B2 * | 3/2011 | Shteynberg et al. | 315/307 |
| 2005/0231133 | A1 * | 10/2005 | Lys | 315/291 |
| 2010/0295472 | A1 * | 11/2010 | Wibben et al. | 315/294 |
| 2010/0308733 | A1 * | 12/2010 | Shao | 315/119 |

* cited by examiner

*Primary Examiner* — David H Vu
(74) *Attorney, Agent, or Firm* — Kirton McConkie; Evan R. Witt

(57) ABSTRACT

A power supply circuit for receiving an input voltage and outputting a driving voltage to at least one LED string. The power supply circuit includes a rear-stage converting circuit and a control circuit. The rear-stage converting circuit is used for receiving the input voltage and converting the input voltage into a compensating voltage. The control circuit is connected to the rear-stage converting circuit and the LED string for detecting the magnitude of a current passing through the LED string, thereby controlling the current passing through the LED string to be identical. The driving voltage is outputted from the power supply circuit. The driving voltage is a summation of the input voltage and the compensating voltage.

10 Claims, 6 Drawing Sheets

POWER SUPPLY CIRCUIT FOR POWERING LIGHT EMITTING DIODE

FIELD OF THE INVENTION

The present invention relates to a power supply circuit, and more particularly to a power supply circuit for powering LEDs with reduced power conversion loss.

BACKGROUND OF THE INVENTION

In recent years, light emitting diodes (LEDs) capable of emitting light with high luminance and high illuminating efficiency have been developed. In comparison with a common incandescent light, a LED has lower power consumption, long service life, and quick response speed. With the maturity of the LED technology, LEDs will replace all conventional lighting facilities. Until now, LEDs are widely used in many aspects of daily lives, such as automobile lighting devices, handheld lighting devices, backlight sources for LCD panels, traffic lights, indicator board displays, and the like.

For increasing the overall brightness values, a plurality of LEDs are connected in series to form a LED string. Due to the fabricating processes, the initiating voltages of different LEDs are somewhat distinguished. Generally, the initiating voltage of respective LED is ranged between 3.2V and 3.6V. That is, the initiating voltage of a specified LED string falls into a specified range. For example, a LED string consisting of thirty serially-connected LEDs has an initiating voltage in the range of between 96V and 108V.

Generally, the LED string is connected to a power supply circuit. The power supply circuit is used to drive illumination of the LED string. Since the initiating voltage of the LED string is in a specified range, a rear-stage converting circuit of the power supply circuit will receive an input voltage from power source (e.g. a utility source) and convert the input voltage into the initiating voltage required for driving illumination of the LED string. By adjusting the initiating voltage, the current passing through the LED string is controlled to a constant value and thus uniform brightness is obtained.

As the number of LEDs contained in the LED string is increased, the input voltage is converted into higher voltage-level driving voltage by the rear-stage converting circuit. Since the input voltage is converted into the higher voltage level, the rear-stage converting circuit has a high power conversion loss and the operating efficiency is impaired. In addition, the rear-stage converting circuit should contain high pressure-resistant components, and thus the conventional power supply circuit is not cost-effective.

For obviating the drawbacks encountered from the prior art, there is a need of providing a power supply circuit for powering LEDs with reduced power conversion loss.

SUMMARY OF THE INVENTION

It is an object of the present invention to provide a power supply circuit for powering at least one LED string, in which the input voltage is converted into a low voltage level by the rear-stage converting circuit in order to reduce the power conversion loss.

It is another object of the present invention to provide a power supply circuit, in which the rear-stage converting circuit has low pressure-resistant components in order to reduce the fabricating cost.

In accordance with an aspect of the present invention, there is provided a power supply circuit for receiving an input voltage through a first positive output terminal and a first negative output terminal of a power-providing device, and outputting a driving voltage to at least one LED string. The power supply circuit includes a second positive output terminal, a second negative output terminal, a rear-stage converting circuit and a control circuit. The second positive output terminal is connected to a first terminal of the LED string. The second negative output terminal is connected to a second terminal of the LED string. The rear-stage converting circuit is used for receiving the input voltage and converting the input voltage into a compensating voltage. The rear-stage converting circuit includes a third positive output terminal and a third negative output terminal. The third positive output terminal is connected to the second positive output terminal, and the third negative output terminal is connected to the first positive output terminal. The control circuit is connected to the rear-stage converting circuit and the LED string for detecting the magnitude of a current passing through the LED string, thereby controlling the current passing through the LED string to be identical. The driving voltage is outputted from the power supply circuit through the second positive output terminal and the second negative output terminal. The driving voltage is a summation of the input voltage and the compensating voltage.

In accordance with another aspect of the present invention, there is provided a power supply circuit for receiving an input voltage and outputting a driving voltage to at least one LED string. The power supply circuit includes a front-stage converting circuit, a second positive output terminal, a second negative output terminal, a rear-stage converting circuit and a control circuit. The front-stage converting circuit is used for receiving the input voltage and converting the input voltage into a transition voltage. The front-stage converting circuit includes a first positive output terminal and a first negative output terminal. The second positive output terminal is connected to a first terminal of the LED string. The second negative output terminal is connected to a second terminal of the LED string. The rear-stage converting circuit is connected to the front-stage converting circuit for receiving the transition voltage and converting the transition voltage. The rear-stage converting circuit includes a third positive output terminal and a third negative output terminal. The third positive output terminal is connected to the second positive output terminal. The third negative output terminal is connected to the first positive output terminal. The control circuit is connected to the rear-stage converting circuit and the LED string for detecting the magnitude of a current passing through the LED string, thereby controlling the current passing through the LED string to be identical. The driving voltage is outputted from the power supply circuit through the second positive output terminal and the second negative output terminal. The driving voltage is a summation of the transition voltage and the compensating voltage.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
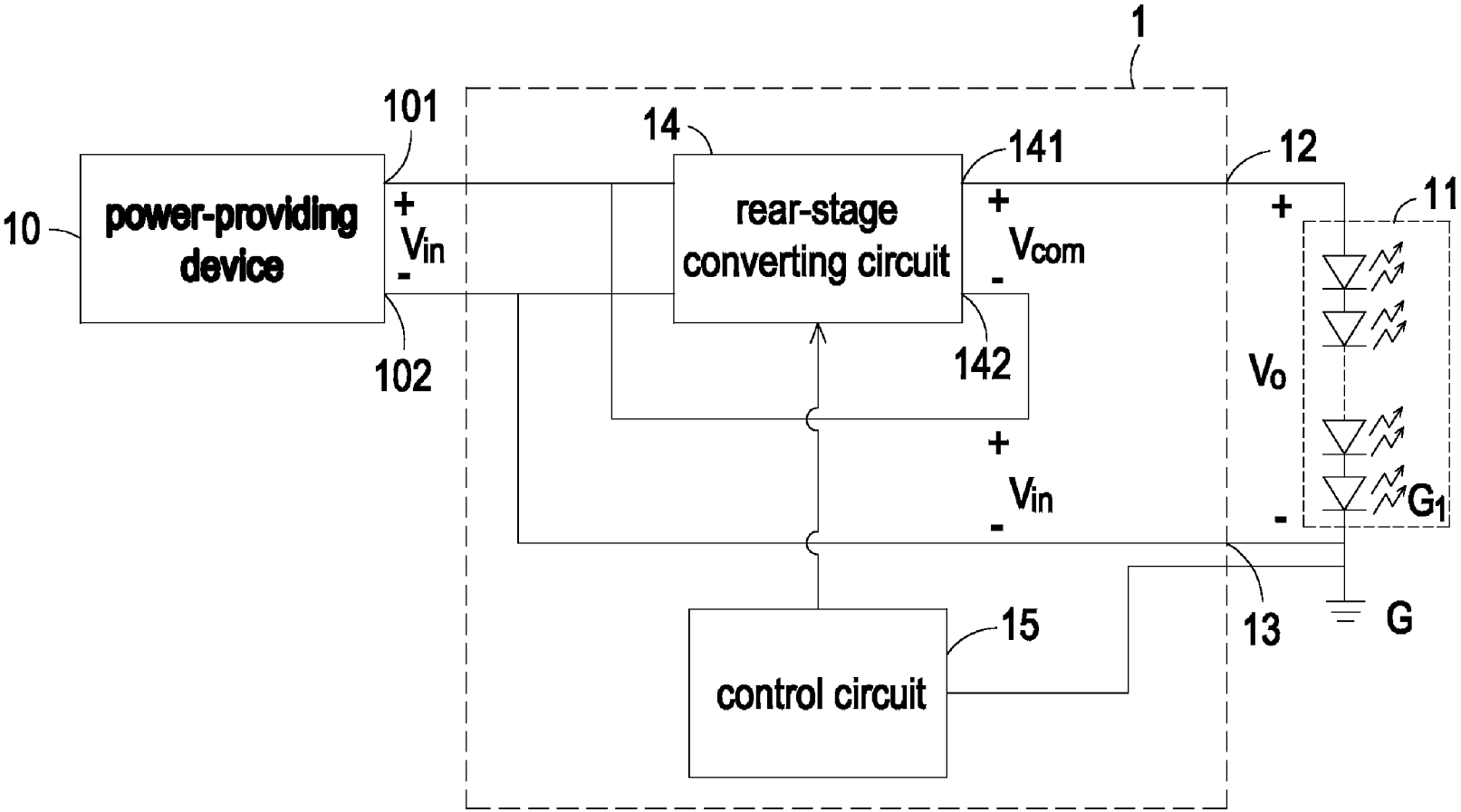
FIG. 1 is a schematic circuit block diagram of a power supply circuit according to a first embodiment of the present invention.

FIG. 1 is a schematic circuit block diagram of a power supply circuit according to a first embodiment of the present invention. The power supply circuit 1 is connected to a power-providing device 10 through a first positive output terminal 101 and a first negative output terminal 102 of the power-providing device 10. After an input voltage $V_{in}$ from the power-providing device 10 is received by the power supply circuit 1, the power supply circuit 1 outputs a driving voltage $V_o$ to at least one LED string 11, thereby illuminating the LED string 11. The LED string 11 includes a plurality of serially-connected LEDs $G_1$.

The power supply circuit 1 comprises a second positive output terminal 12, a second negative output terminal 13, a rear-stage converting circuit 14 and a control circuit 15. The second positive output terminal 12 is connected to a first terminal of the LED string 11. The second negative output terminal 13 is connected to a second terminal of the LED string 11, a common terminal G and the first negative output terminal 102 of the power-providing device 10. The input voltage $V_{in}$ from the power-providing device 10 is received by the rear-stage converting circuit 14. By the rear-stage converting circuit 14, the input voltage $V_{in}$ is converted into a compensating voltage $V_{com}$. The rear-stage converting circuit 14 comprises a third positive output terminal 141 and a third negative output terminal 142. The third positive output terminal 141 is connected to the second positive output terminal 12 of the power supply circuit 1. The third negative output terminal 142 is connected to the first positive output terminal 101 of the power-providing device 10. The control circuit 15 is connected to the rear-stage converting circuit 14 and the LED string 11 for detecting the magnitude of the current passing through the LED string 11, thereby controlling the current passing through the LED string 11 to be identical.

In this embodiment, the driving voltage $V_o$ is outputted from the power supply circuit 1 to the LED string 11 through the second positive output terminal 12 and the second negative output terminal 13. The third positive output terminal 141 of the rear-stage converting circuit 14 is connected to the second positive output terminal 12 of the power supply circuit 1. The third negative output terminal 142 of the rear-stage converting circuit 14 is connected to the first positive output terminal 101 of the power-providing device 10. The second negative output terminal 13 of the power supply circuit 1 is connected to the first negative output terminal 102 of the power-providing device 10. A difference between the second positive output terminal 12 and the second negative output terminal 13 of the power supply circuit 1 is substantially equal to a summation of the compensating voltage $V_{com}$ and the input voltage $V_{in}$. In other words, the driving voltage $V_o$ outputted from the power supply circuit 1 is equal to the summation of the compensating voltage $V_{com}$ and the input voltage $V_{in}$.

Since the driving voltage $V_o$ outputted from the power supply circuit 1 is equal to the summation of the compensating voltage $V_{com}$ and the input voltage $V_{in}$, the power-providing device 10 could directly provide most electrical energy required for powering the LED string 11. Under this circumstance, the rear-stage converting circuit 14 only needs to provide the electrical energy for compensating the variation of the initiating voltage of the LED string 11. In other words, by the rear-stage converting circuit 14, the input voltage $V_{in}$ is converted into the compensating voltage $V_{com}$, which has a relatively lower voltage level. Since the input voltage $V_{in}$ is converted into a low voltage level, the rear-stage converting circuit 14 has a low energy conversion ratio. Under this circumstance, the power conversion loss of the power supply circuit 1 is reduced and the operating efficiency is enhanced. Moreover, in views of cost-effectiveness, the components of the rear-stage converting circuit 14 are low pressure-resistant components.

For example, in an embodiment, the LED string 11 comprises thirty LEDs $G_1$. The initiating voltage of each LED $G_1$ is ranged between 3.2V and 3.6V. As such, the initiating voltage of the LED string 11 is in the range of between 96V and 108V. If the input voltage $V_{in}$ provided by the power-providing device 10 is 80V, the rear-stage converting circuit 14 will convert the input voltage $V_{in}$ into a compensating voltage $V_{com}$ having a voltage level in the range of between 16V and 28V. Since the driving voltage $V_o$ outputted from the power supply circuit 1 is equal to the summation of the compensating voltage $V_{com}$ and the input voltage $V_{in}$, the LED string 11 will be driven to illuminate. In addition, since the compensating voltage $V_{com}$ has a low voltage level, the rear-stage converting circuit 14 has a low energy conversion ratio. Under this circumstance, the power conversion loss of the power supply circuit 1 is reduced and the operating efficiency is enhanced. Moreover, in views of cost-effectiveness, the components of the rear-stage converting circuit 14 are low pressure-resistant components.

In an embodiment, the rear-stage converting circuit 14 is a DC-to-DC converting circuit. Correspondingly, the input voltage $V_{in}$ received by the rear-stage converting circuit 14 is a DC voltage.

In some embodiments, the input voltage $V_{in}$ has a constant voltage level. According to the number of LEDs $G_1$ contained in the LED string 11, the voltage level of the input voltage $V_{in}$ is determined or adjusted. In some embodiments, the power-providing device 10 is a power factor correction circuit.

Figure 2:
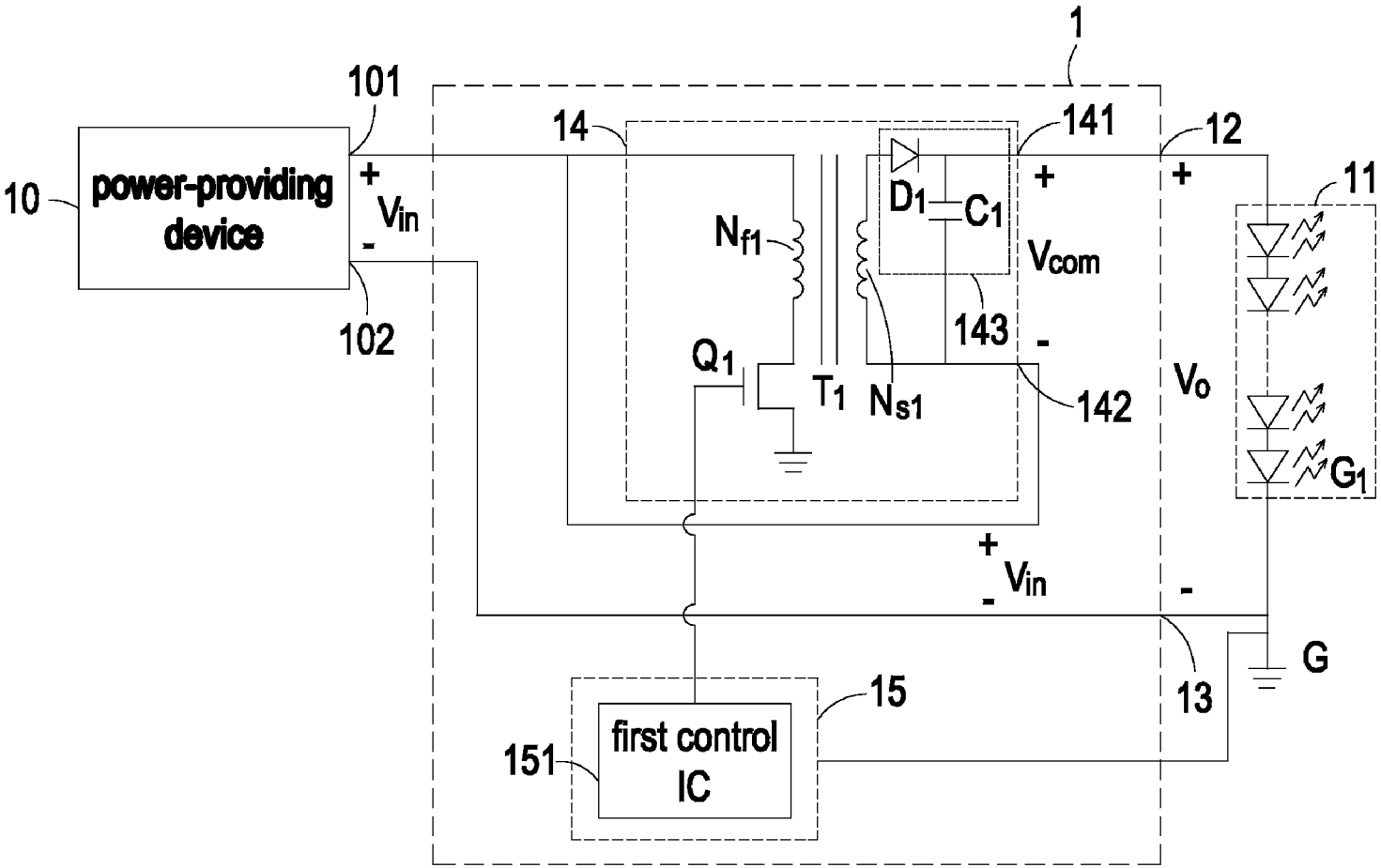
FIG. 2 is a schematic detailed circuit block diagram illustrating an exemplary power supply circuit shown in FIG. 1.

FIG. 2 is a schematic detailed circuit block diagram illustrating an exemplary power supply circuit shown in FIG. 1. As shown in FIG. 2, the control circuit 15 comprises a first control IC (integrated circuit) 151. In this embodiment, the rear-stage converting circuit 14 is a fly back DC-to-DC converting circuit. The rear-stage converting circuit 14 comprises a first transformer $T_1$, a first switch element $Q_1$ and a first rectifier-filter circuit 143. The first transformer $T_1$ comprises a first primary winding assembly $N_{f1}$ and a first secondary winding assembly $N_{s1}$. The first primary winding assembly $N_{f1}$ is connected to the first positive output terminal 101 of the power-providing device 10 and the first switch element $Q_1$. The first secondary winding assembly $N_{s1}$ is connected to the first rectifier-filter circuit 143 and the first positive output terminal 101 of the power-providing device 10. The first switch element $Q_1$ is serially connected between the first primary winding assembly $N_{f1}$ and the common terminal G. The control terminal of the first switch element $Q_1$ is connected to the first control IC 151 of the control circuit 15. Under control of the first control IC 151 of the control circuit 15, the first switch element $Q_1$ is selectively conducted or shut off. As such, the electrical energy received by the first primary winding assembly $N_{f1}$ of the first transformer $T_1$ is electromagnetically transmitted to the first secondary winding assembly $N_{s1}$, and the first secondary winding assembly $N_{s1}$ generates induction energy.

The first rectifier-filter circuit 143 is used for rectifying and filtering the electrical energy of first secondary winding assembly $N_{s1}$, thereby outputting the compensating voltage $V_{com}$. In an embodiment, the first rectifier-filter circuit 143 comprises a first diode $D_1$ and a first capacitor $C_1$. The anode of the first diode $D_1$ is connected to the first secondary winding assembly $N_{s1}$ of the first transformer $T_1$. The cathode of the first diode $D_1$ is connected to the third positive output terminal 141 of the rear-stage converting circuit 14. An end of the first capacitor $C_1$ is connected to the cathode of the first diode $D_1$ and the third positive output terminal 141 of the rear-stage converting circuit 14. The other end of the first capacitor $C_1$ is connected to the third negative output terminal 142 of the rear-stage converting circuit 14. Through the third negative output terminal 142, the first capacitor $C_1$ is connected to the first positive output terminal 101 of the power-providing device 10.

Figure 3:
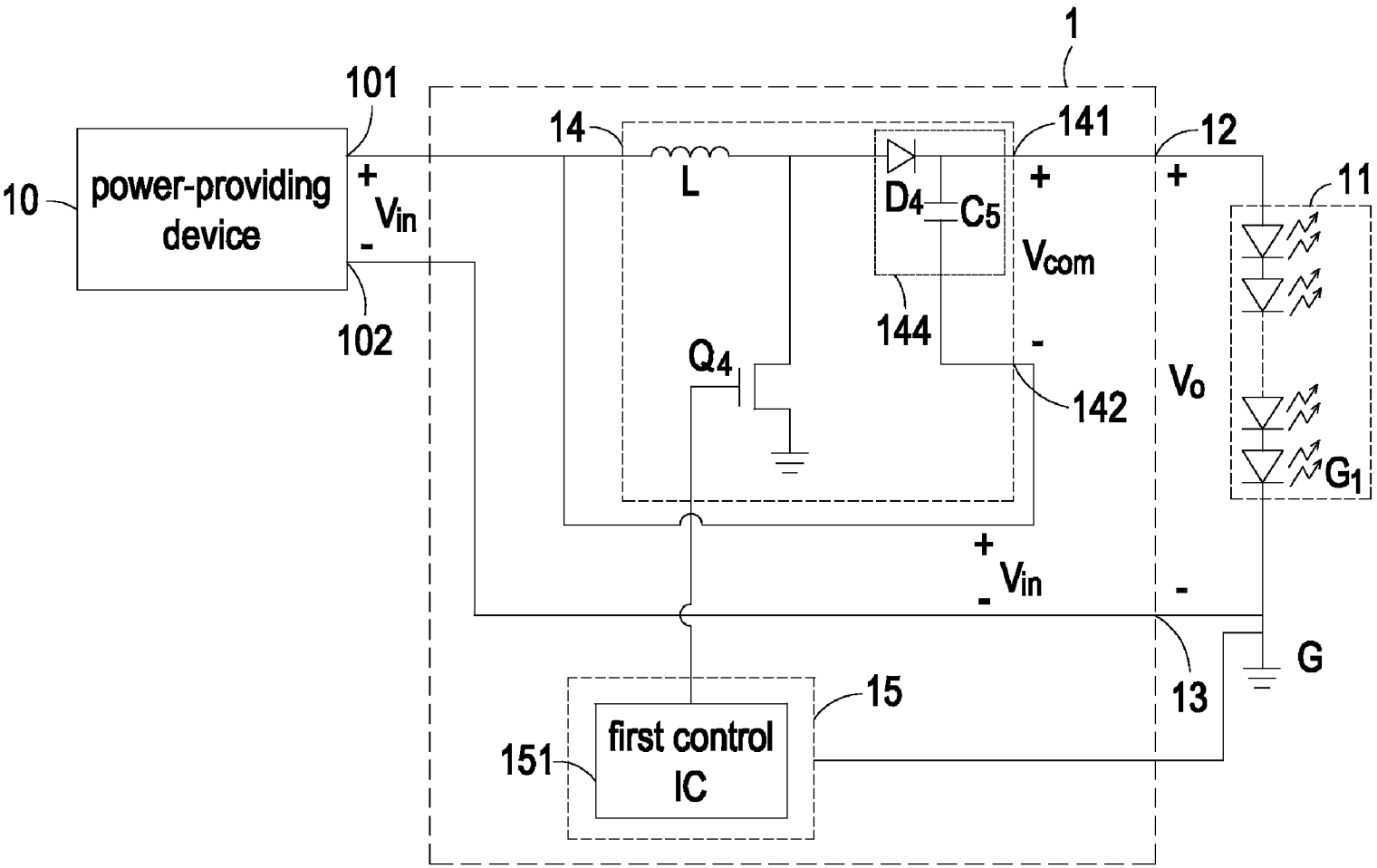
FIG. 3 is a schematic detailed circuit block diagram illustrating another exemplary power supply circuit shown in FIG. 1.

FIG. 3 is a schematic detailed circuit block diagram illustrating another exemplary power supply circuit shown in FIG. 1. In this embodiment, the rear-stage converting circuit 14 is a buck-boost DC-to-DC converting circuit. The rear-stage converting circuit 14 comprises a boost inductor L, a fourth switch element $Q_4$ and a third rectifier-filter circuit 144. An end of the boost inductor L is connected to the first positive output terminal 101 of the power-providing device 10. The other end of the boost inductor L is connected to a first terminal of the fourth switch element $Q_4$ and the third rectifier-filter circuit 144. A second terminal of the fourth switch element $Q_4$ is connected to the common terminal G. A control terminal of the fourth switch element $Q_4$ is connected to the first control IC 151 of the control circuit 15. Under control of the first control IC 151 of the control circuit 15, the fourth switch element $Q_4$ is selectively conducted or shut off. As such, the input voltage $V_{in}$ received by the boost inductor L is stepped up.

The third rectifier-filter circuit 144 is used for rectifying and filtering stepped-up voltage, thereby outputting the compensating voltage $V_{com}$. In an embodiment, the third rectifier-filter circuit 144 comprises a fourth diode $D_4$ and a fifth capacitor $C_5$. The anode of the fourth diode $D_4$ is connected to the boost inductor L. The cathode of the fourth diode $D_4$ is connected to the third positive output terminal 141 of the rear-stage converting circuit 14. An end of the fifth capacitor $C_5$ is connected to the cathode of the fourth diode $D_{41}$ and the third positive output terminal 141 of the rear-stage converting circuit 14. The other end of the fifth capacitor $C_5$ is connected to the third negative output terminal 142 of the rear-stage converting circuit 14. Through the third negative output terminal 142, the fifth capacitor $C_5$ is connected to the first positive output terminal 101 of the power-providing device 10.

Figure 4:
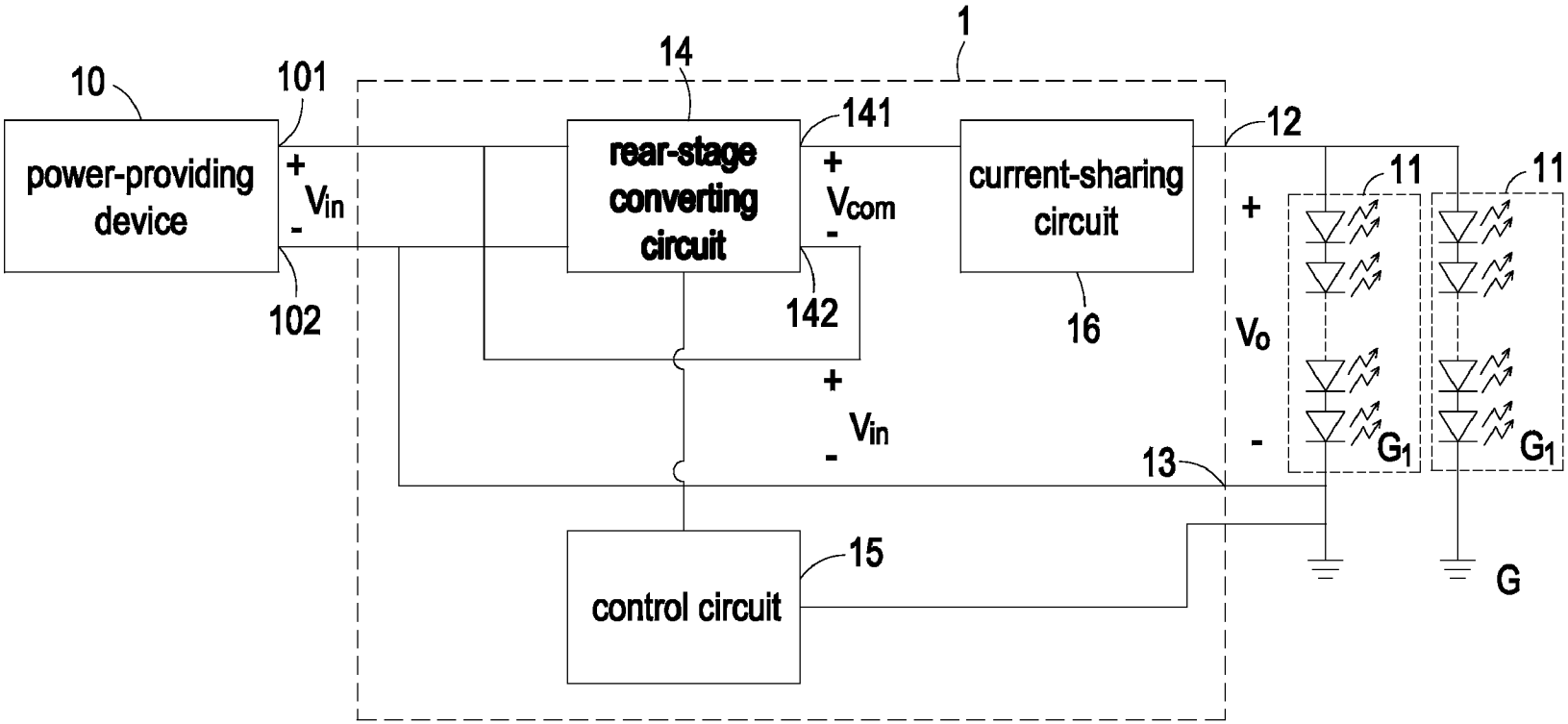
FIG. 4 is a schematic circuit block diagram of a power supply circuit according to a second embodiment of the present invention.

FIG. 4 is a schematic circuit block diagram of a power supply circuit according to a second embodiment of the present invention. As shown in FIG. 4, the power supply circuit 1 is connected with multiple LED strings 11 in order to simultaneously drive illumination of the LED strings 11. The LED strings 11 are connected with each other in parallel. For obtaining uniform brightness of the multiple LED strings 11, the power supply circuit 1 further comprises a current-sharing circuit 16. The current-sharing circuit 16 is connected to the third positive output terminal 141 of the rear-stage converting circuit 14 and the multiple LED strings 11 for balancing the currents passing through all LED strings 11, thereby obtaining uniform brightness.

Figure 5:
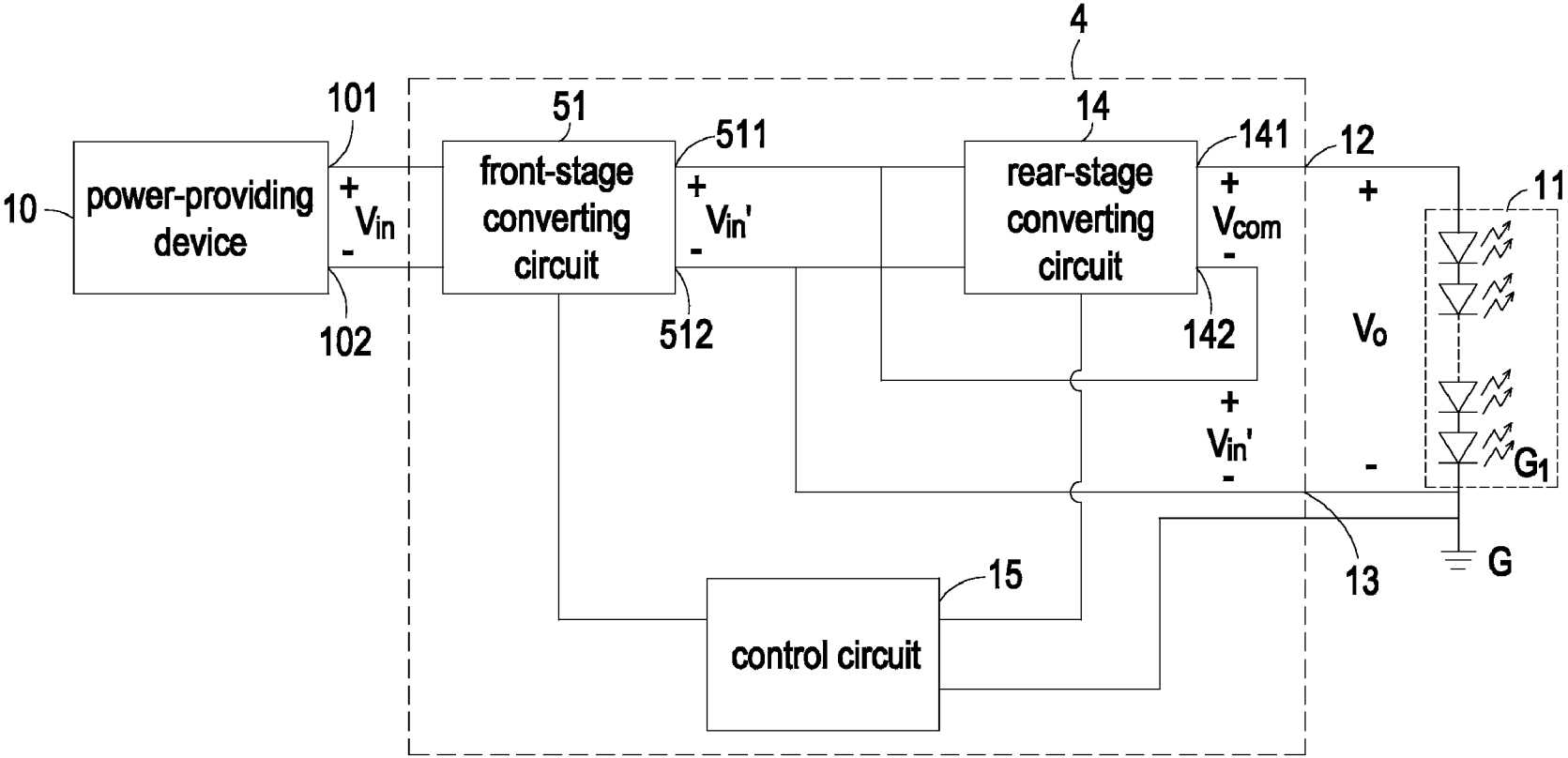
FIG. 5 is a schematic circuit block diagram of a power supply circuit according to a third embodiment of the present invention.

FIG. 5 is a schematic circuit block diagram of a power supply circuit according to a third embodiment of the present invention. In comparison with the power supply circuit 1 of FIG. 1, the power supply circuit 4 of FIG. 4 further comprises a front-stage converting circuit 51. The front-stage converting circuit 51 is interconnected between the power-providing device 10 and the rear-stage converting circuit 14. The front-stage converting circuit 51 comprises a fourth positive output terminal 511 and a fourth negative output terminal 512. The input voltage $V_{in}$ from the power-providing device 10 is received by the front-stage converting circuit 51. By the front-stage converting circuit 51, the input voltage $V_{in}$ is converted into a transition voltage $V_{in'}$, which is outputted from the fourth positive output terminal 511 and the fourth negative output terminal 512. The transition voltage $V_{in'}$ is received by the rear-stage converting circuit 14. By the rear-stage converting circuit 14, the transition voltage $V_{in'}$ is converted into a compensating voltage $V_{com}$. The second negative output terminal 13 of the power supply circuit 4 is connected to the fourth negative output terminal 512 of the front-stage converting circuit 51. The third negative output terminal 142 of the power supply circuit 4 is connected to the fourth positive output terminal 511 of the front-stage converting circuit 51. As a consequence, the driving voltage $V_o$ outputted from the power supply circuit 4 is equal to the summation of the compensating voltage $V_{com}$ and the transition voltage $V_{in'}$.

Since the driving voltage $V_o$ outputted from the power supply circuit 4 is equal to the summation of the compensating voltage $V_{com}$ and the transition voltage $V_{in'}$, the front-stage converting circuit 51 could directly provide most electrical energy required for powering the LED string 11. Under this circumstance, the rear-stage converting circuit 14 only needs to provide the electrical energy for compensating the variation of the initiating voltage of the LED string 11. In other words, by the rear-stage converting circuit 14, the transition voltage $V_{in'}$ is converted into the compensating voltage $V_{com}$, which has a relatively lower voltage level. Since the transition voltage $V_{in'}$ is converted into a low voltage level, the rear-stage converting circuit 14 has a low energy conversion ratio. Under this circumstance, the power conversion loss of the power supply circuit 4 is reduced and the operating efficiency is enhanced. Moreover, in views of cost-effectiveness, the components of the rear-stage converting circuit 14 are low pressure-resistant components.

In an embodiment, the front-stage converting circuit 51 is an AC-to-DC converting circuit. Correspondingly, the input voltage $V_{in}$ received by the front-stage converting circuit 51 is an AC voltage.

Figure 6:
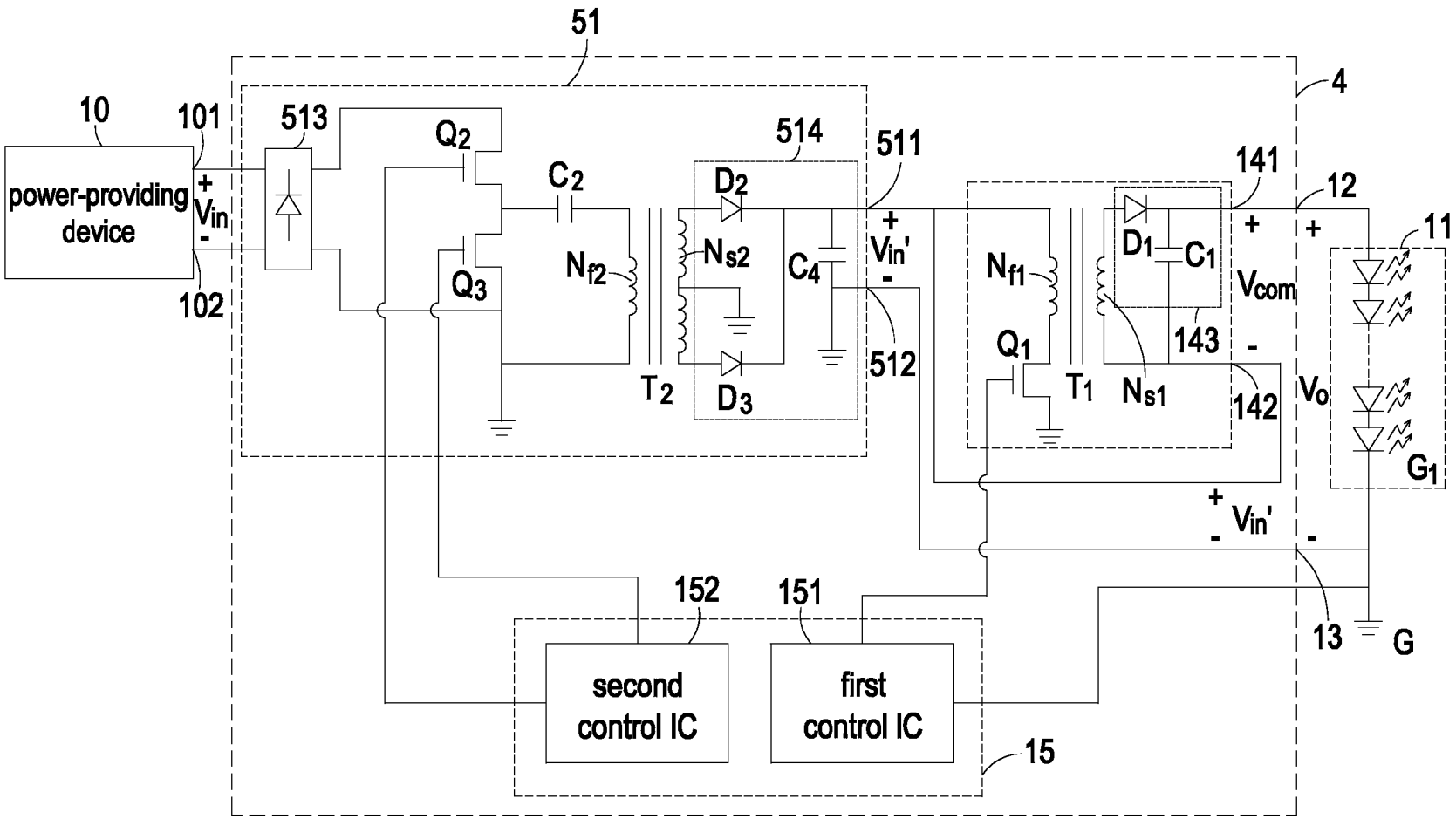
FIG. 6 is a schematic detailed circuit block diagram illustrating an exemplary power supply circuit shown in FIG. 5.

FIG. 6 is a schematic detailed circuit block diagram illustrating an exemplary power supply circuit shown in FIG. 5. In this embodiment, the front-stage converting circuit 51 is a half-bridge AC-to-DC converting circuit. In this embodiment, the rear-stage converting circuit 14 is a fly back DC-to-DC converting circuit. The rear-stage converting circuit 14 comprises a first transformer $T_1$, a first switch element $Q_1$ and a first rectifier-filter circuit 143. The operating functions of the rear-stage converting circuit 14 are identical to those shown in FIG. 2, and are not redundantly described herein.

As shown in FIG. 6, the control circuit 15 comprises a first control IC 151 and a second control IC 152. The front-stage converting circuit 51 comprises a rectifier 513, a second transformer $T_2$, a second switch element $Q_2$, a third switch element $Q_3$, a second capacitor $C_2$ and a second rectifier-filter circuit 514. The rectifier 513 is connected to the power-providing device 10 for rectifying the input voltage $V_{in}$. The second switch element $Q_2$ is connected to the rectifier 513 and the third switch element $Q_3$. The third switch element $Q_3$ has a terminal connected to the common terminal G. The control terminals of the second switch element $Q_2$ and the third switch element $Q_3$ are connected to the second control IC 152 of the control circuit 15. Under control of the second control IC 152 of the control circuit 15, the second switch element $Q_2$ and the third switch element $Q_3$ are alternately conducted or shut off.

An end of the second capacitor $C_2$ is connected to the second switch element $Q_2$ and the third switch element $Q_3$. The second capacitor $C_2$ is used for filtering off noise. The second transformer $T_2$ comprises a second primary winding assembly $N_{f2}$ and a second secondary winding assembly $N_{s2}$. Both ends of the second primary winding assembly $N_{f2}$ are respectively connected to the other end of the second capacitor $C_2$ and the common terminal G. The center-tapped head of the second secondary winding assembly $N_{s2}$ is connected to the common terminal G. Since the second switch element $Q_2$ and the third switch element $Q_3$ are alternately conducted or shut off, the electrical energy received by the second primary winding assembly $N_{f2}$ is electromagnetically transmitted to the second secondary winding assembly $N_{s2}$, and the second secondary winding assembly $N_{s2}$ generates induction energy.

The second rectifier-filter circuit 514 is connected to the second secondary winding assembly $N_{s2}$ of the second transformer $T_2$, the fourth positive output terminal 511 and the fourth negative output terminal 512 of the front-stage converting circuit 51 for rectifying and filtering electrical energy. In an embodiment, the second rectifier-filter circuit 514 comprises a second diode $D_2$, a third diode $D_3$ and a fourth capacitor $C_4$. The anodes of the second diode $D_2$ and the third diode $D_3$ are respectively connected to both ends of the second secondary winding assembly $N_{s2}$ of the second transformer $T_2$. The cathode of the second diode $D_2$ is connected to the anode of the third diode $D_3$. An end of the fourth capacitor $C_4$ is connected to the cathodes of the second diode $D_2$ and the third diode $D_3$ and the fourth positive output terminal 511 of the front-stage converting circuit 51. The other end of the fourth capacitor $C_4$ is connected to the fourth negative output terminal 512 of the front-stage converting circuit 51 and the common terminal G.

From the above description, the driving voltage outputted by the power supply circuit of the present invention for powering the LED string is mostly provided by the input voltage. The rear-stage converting circuit only needs to provide the electrical energy for compensating the variation of the initiating voltage of the LED string. In other words, by the rear-stage converting circuit, the input voltage is converted into the compensating voltage, which has a relatively lower voltage level. Since the input voltage is converted into a low voltage level, the rear-stage converting circuit has a low energy conversion ratio. Under this circumstance, the power conversion loss of the power supply circuit is reduced and the operating efficiency is enhanced. Moreover, in views of cost-effectiveness, the components of the rear-stage converting circuit are low pressure-resistant components.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power supply circuit for receiving an input voltage through a first positive output terminal and a first negative output terminal of a power-providing device, and outputting a driving voltage to at least one LED string, said power supply circuit comprising:

a second positive output terminal connected to a first terminal of said LED string;

a second negative output terminal connected to a second terminal of said LED string;

a rear-stage converting circuit for receiving said input voltage and converting said input voltage into a compensating voltage, wherein said rear-stage converting circuit comprises a third positive output terminal and a third negative output terminal, said third positive output terminal is connected to said second positive output terminal, and said third negative output terminal is connected to said first positive output terminal; and a control circuit connected to said rear-stage converting circuit and said LED string for detecting the magnitude of a current passing through said LED string, thereby controlling said current passing through said LED string to be identical, wherein said driving voltage is outputted from said power supply circuit through said second positive output terminal and said second negative output terminal, and said driving voltage is a summation of said input voltage and said compensating voltage.

2. The power supply circuit according to claim 1 wherein said LED string includes a plurality of serially-connected LEDs, and said LED string has an initiating voltage in a specified range.

3. The power supply circuit according to claim 1 wherein said input voltage is a DC voltage, and said rear-stage converting circuit is a fly back DC-to-DC converting circuit or a buck-boost DC-to-DC converting circuit.

4. The power supply circuit according to claim 1 wherein said control circuit comprises a control integrated circuit, said rear-stage converting circuit comprises a switch element connected to said control integrated circuit of said control circuit, and said switch element is selectively conducted or shut off under control of said control circuit.

5. The power supply circuit according to claim 4 wherein said rear-stage converting circuit comprises a transformer having a primary winding assembly and a secondary winding assembly, wherein said primary winding assembly is connected to said first positive output terminal of said power-providing device and said switch element.

6. The power supply circuit according to claim 5 wherein said rear-stage converting circuit comprises a rectifier-filter circuit, which is connected to said secondary winding assembly of said transformer for rectifying and filtering electrical energy of said secondary winding assembly.

7. The power supply circuit according to claim 6 wherein said rectifier-filter circuit comprises a diode and a capacitor.

8. The power supply circuit according to claim 6 wherein said rear-stage converting circuit comprises a boost inductor and a rectifier-filter circuit, wherein an end of said boost inductor is connected to said first positive output terminal of said power-providing device, and the other end of said boost inductor is connected to said switch element and said rectifier-filter circuit.

9. The power supply circuit according to claim 1 wherein said at least one LED string comprises multiple LED strings connected with each other in parallel, and said power supply circuit further comprises a current-sharing circuit, which is connected to said third positive output terminal of said rear-stage converting circuit and said multiple LED strings for balancing the currents passing through said multiple LED strings.

10. The power supply circuit according to claim 1 wherein said power-providing device is a power factor correction circuit.

* * * * *